United States Patent [19]

Isohata

[11] Patent Number: 4,699,444

[45] Date of Patent: Oct. 13, 1987

[54] ELECTRICAL RECEPTACLE WHICH ASSURES POSITIVE CONNECTION

[75] Inventor: Shigeru Isohata, Machida, Japan

[73] Assignee: AMP Incorporated, Harrisburg, Pa.

[21] Appl. No.: 839,755

[22] Filed: Mar. 14, 1986

[30] Foreign Application Priority Data

Apr. 11, 1985 [JP] Japan ..... 60-077520

[51] Int. Cl.[4] ..... H01R 13/11

[52] U.S. Cl. ..... 439/839; 439/852

[58] Field of Search ..... 339/258 R, 258 P, 258 S, 339/259 R

[56] References Cited

U.S. PATENT DOCUMENTS

| | | | |
|---|---|---|---|
| 2,105,884 | 1/1938 | Hanser et al. | 339/259 R |
| 3,409,867 | 11/1968 | Lessner | 339/258 S |
| 4,266,845 | 5/1981 | Ishikawa | 339/258 R |
| 4,491,382 | 1/1985 | Ishikawa | 339/259 R |
| 4,534,610 | 8/1985 | Takihara | 339/259 R |
| 4,560,231 | 12/1985 | Ihirai | 339/258 R |

FOREIGN PATENT DOCUMENTS

| | | | |
|---|---|---|---|
| 3231484 | 3/1983 | Fed. Rep. of Germany | 339/258 R |

*Primary Examiner*—Gil Weidenfeld
*Assistant Examiner*—Daniel W. Howell
*Attorney, Agent, or Firm*—Bruce J. Wolstoncroft; Adrian J. LaRue

[57] ABSTRACT

A receptacle terminal has a receptacle portion including leaf spring means at a forward end of the receptacle portion that are inclined toward an upper wall and auxiliary spring means spaced rearwardly from the forward leaf spring means. Upon insertion of a tab portion of a male terminal into the receptacle portion the leaf spring means can engage the auxiliary leaf spring means or the bottom wall and the auxiliary leaf spring means can engage the bottom wall thereby preventing the leaf springs from deformation. Accordingly, a permanent set of the leaf springs cannot occur enabling the spring forces to remain constant which ensures optimal contact pressure on the tab portion realizing an effective electrical connection.

19 Claims, 8 Drawing Figures

ELECTRICAL RECEPTACLE WHICH ASSURES POSITIVE CONNECTION

FIELD OF THE INVENTION

The invention relates to an electrical terminal and more particularly, to an electrical terminal having a receptacle section, which prevents overstressing of the spring contact members assuring a positive electrical connection.

BACKGROUND OF THE INVENTION

A variety of terminal means for electrically connecting wires have been proposed and put into practical use. One such terminal means comprises a male terminal connected to an end of a wire and a receptacle terminal connected to an end of another wire, such that a tab portion of the male terminal is inserted into the receptacle portion of the receptacle terminal. The tab portion is resiliently disposed in the receptacle portion, electrically connecting the two terminals to each other.

Although the use of such terminal means ensures easy engagement of the terminals, the electrical connection of the terminals is assured through the spring force of the receptacle portion. Accordingly, when the spring force is reduced, the electrical connection of the terminals tends to be poor, resulting in a reliability problem; particularly, since the spring force of the receptacle portion is obtained through the function of a leaf spring formed by bending a section of the receptacle portion into a predetermined shape. Poor connection will occur when the spring force of the leaf spring is decreased due to a permanent set thereof created when the tab portion of the male terminal is inserted into the receptacle portion of the receptacle terminal in an improper manner when they are mated together.

SUMMARY OF THE INVENTION

An object of the present invention is to provide a receptacle terminal which prevents a permanent set of the spring contact means and maintains a positive electrical connection with the male terminal even when the spring contact means is overstressed by the improper insertion of the tab portion of the male terminal into the receptacle portion of the receptacle terminal.

According to the present invention, the receptacle terminal comprises a receptacle portion which can resiliently engage the tab portion of the male terminal, and includes a wire terminating means, two main leaf springs extending backwardly from a front end of a bottom wall of the receptacle portion and an auxiliary spring extending backwardly from a forward section of the bottom wall of the receptacle portion. The leaf springs extend toward an upper wall and are spaced therefrom as well as from each other so that upon insertion of the tab portion into the receptacle portion, the main leaf springs can engage the auxiliary spring or bottom wall and the auxiliary spring can engage the bottom wall thereby preventing the leaf springs from being bent in excess of a predetermined amount when the tab portion is improperly inserted, which in turn prevents the spring forces from being lowered due to the leaf springs taking a permanent set.

DETAILED DESCRIPTION OF THE INVENTION

Figure 1:
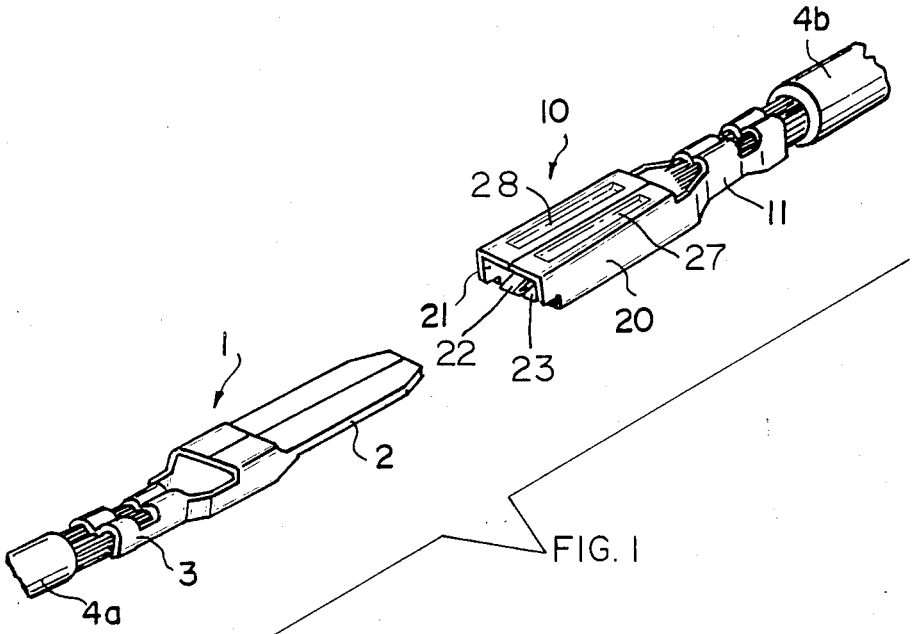
FIG. 1 is a perspective view of the receptacle terminal according to the present invention with a male terminal exploded therefrom.
Figure 2:
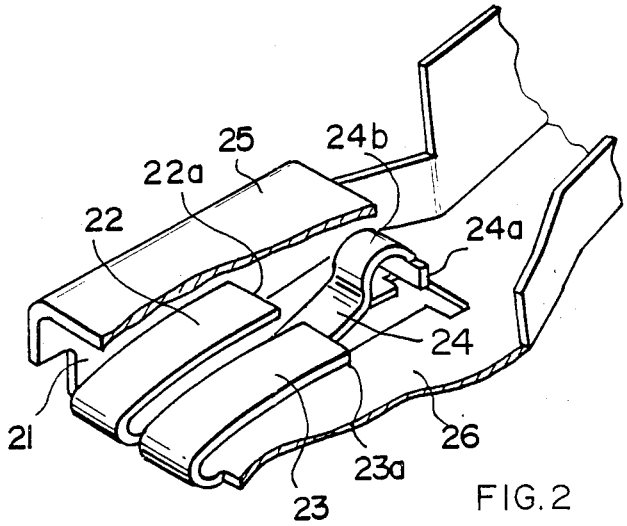
FIG. 2 is a perspective and part cross-sectional view of the receptacle portion.
Figure 3:
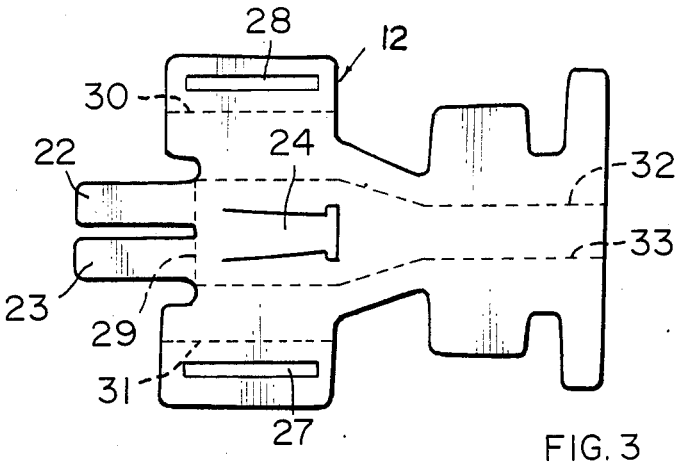
FIG. 3 is a top plan view of the metal blank from which the receptacle terminal of FIG. 1 is formed.

The receptacle terminal 10 according to the present invention is made from a metal sheet having desirable conductive and spring characteristics by stamping and folding a stamped blank along lines 29–33 shown in FIG. 3.

Receptacle terminal 10 has a receptacle portion 20, the transverse cross-section of which is of a rectangular shape, for receiving therein a tab portion 2 of a male terminal 1 and a wire terminating means 11 for terminating a wire 4*b*. The male terminal 1 has tab portion 2 and a wire terminating means 3 for terminating a wire 4*a*.

Receptacle portion 20 includes two main leaf spring 22, 23 which are bent at a front end of the receptacle portion along line 29 (FIG. 3) and which are integral with bottom wall 26. Main leaf springs 22, 23 project forward from bottom wall 26 and are bent backward within the receptacle portion 20 in a direction away from the bottom wall 26 as cantilever contact members. Main leaf springs 22, 23 are positioned parallel to each other on the left and right sides of a longitudinal axis of the receptacle portion 20.

Embossments 22*b*, 23*b* are positioned on each main leaf spring 22, 23 adjacent the free ends 22*a*, 23*a*. Free ends 22*a*, 23*a* are curved such that when not engaged with tab portion 2, free ends 22*a*, 23*a* are substantially parallel to the bottom wall 26. Free ends 22*a*, 23*a* are positioned in receptacle portion 20 with gap h in between an upper wall 25 and free ends 22*a*, 23*a*. Gap h is less than a thickness t of the tab portion 2 to be inserted between upper wall 25 and leaf springs 22,23.

An auxiliary leaf spring 24 has a T-shaped configuration when stamped out of bottom wall 26 as shown in FIG. 3 and extends backward within the receptacle portion 20 from a forward section of bottom wall 26 and in a direction away from bottom wall 26 as a cantilever contact member. The auxiliary leaf spring 24 is finally formed to have an arcuate contact section 24*b* with the outer leg 24*a* of the T being aligned substantially perpendicular to the bottom wall 26. Arcuate contact section 24*b* is positioned in receptacle portion 20 with a substantially similar gap h between upper wall 25 and arcuate contact section 24*b*, as is found between upper wall 25 and free ends 22*a*, 23*a* of main leaf springs 22, 23. The auxiliary leaf spring 24 is centered behind free ends 22*a*, 23*a* of main springs 22, 23.

Upper wall 25 of the receptacle portion 20 has two inwardly directed longitudinal projections 27, 28 which engage tab portion 2 when tab portion 2 is inserted into receptacle portion 20.

Figure 4A:
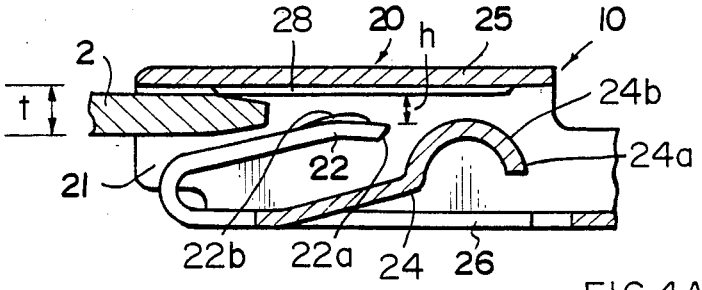
FIGS. 4A to 4D are cross-sectional views of the receptacle portion illustrating the various stages of insertion of the tab portion of the male terminal therein.
Figure 4B:
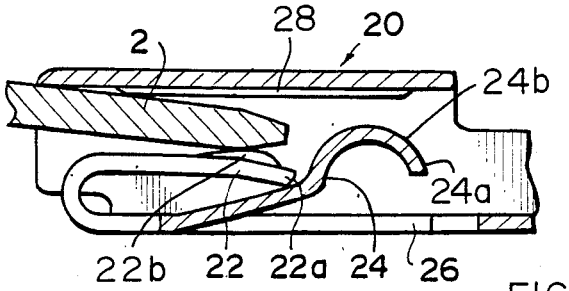
Figure 4C:
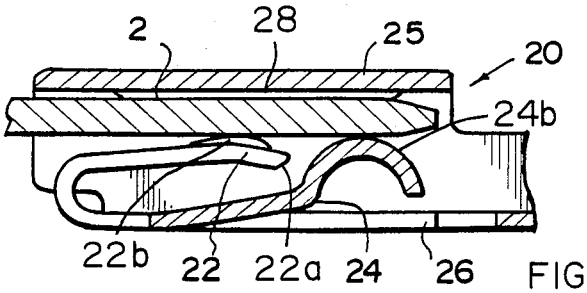

When tab portion 2 of male terminal 1 is inserted into receptacle portion 20 of receptacle terminal 10 through a front end opening 21, tab portion 2 engages main leaf springs 22, 23 and presses main leaf springs 22, 23 toward bottom wall 26. As tab portion 2 is inserted further into receptacle portion 20 and improper insertion occurs, as shown in FIG. 4*b*, main leaf springs 22,23 engage auxiliary leaf spring 24 increasing the spring force and preventing main leaf springs 22, 23 from being deformed and taking a permanent set. Although main leaf springs 22, 23 are normally engaged with auxiliary spring 24, main leaf springs 22, 23 may be brought into contact with the bottom wall 26 if auxiliary leaf spring 24 is positioned further back along bottom wall 26 away from main leaf springs 22, 23. Further insertion of tab portion 2 depresses auxiliary spring 24 so that all leaf springs 22, 23, 24 are in contact with tab portion 2 thereby pressing tab portion 2 against inwardly directed longitudinal projections 27, 28 on upper wall 25, as shown in FIG. 4C. This optimal insertion position occurs when the insertion axis of tab portion 2 is parallel with upper wall 25.

Figure 4D:
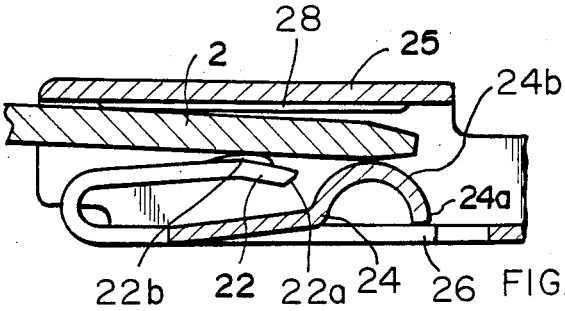

FIG. 4D shows the condition wherein tab portion 2 of male terminal 10 is exerting more stress on auxiliary leaf spring 24 than is exerted under an optimal insertion position. In this case, auxiliary leaf spring 24 is depressed down toward bottom wall 26 with outer leg 24*a* of auxiliary leaf spring 24 engaging bottom surface 26 thereby preventing deformation of auxiliary leaf spring 24.

Figure 5:
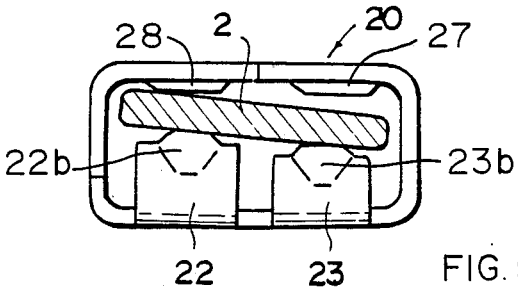
FIG. 5 is a front elevational view illustrating the condition wherein the tab portion of the male terminal is improperly inserted into the receptacle terminal.

FIG. 5 shows receptacle portion 20 of receptacle terminal 10, illustrating the condition wherein tab portion 2 is inserted at an angle into receptacle portion 20. In this case, main leaf spring 23 is depressed, but the free end 23*a* thereof engages auxiliary leaf spring 24 of bottom wall 26 of prevent deformation of main leaf spring 23.

The present invention, as described above, is constructed in such a way that upon insertion of the tab portion of the male terminal into the receptacle portion of the receptacle terminal, the leaf springs will interact with each other and the base wall in such a manner as to prevent deformation of the leaf springs. Therefore, the tab portion may be properly or improperly inserted into the receptacle portion without having the spring forcs lowered due to the leaf springs being deformed thereby taking a permanent set. Accordingly, this receptacle maintains the optimum contact pressure on the tab portion realizing an effective electrical connection.

I claim:

1. A receptacle terminal comprising:

a receptacle portion having a bottom wall and an upper wall;

main leaf spring means extending from a forward end of said bottom wall, the main leaf spring means being bent so as to extend backward into said receptacle portion along the bottom wall at an inclined angle relative thereto, free end means of said main leaf spring means spaced from said upper wall a distance less than the thickness of a tab portion of a male terminal;

auxiliary leaf spring means extending from said bottom wall and extending backward into said receptacle portion along the bottom wall at an inclined anlge relative to the bottom wall, free end means of the auxiliary leaf spring means spaced from said upper wall at a distance less than the thickness of said tab portion;

the main leaf spring means having a first stop means and the auxiliary spring means having a second stop means, whereby upon the tab portion being inserted into the receptacle portion, the first stop means can engage the auxiliary leaf spring means, and upon further insertion of the tab portion, the auxiliary leaf spring means will move, such that the second stop means will engage the bottom wall when the tab portion is improperly inserted into the receptacle portion, thereby preventing the leaf spring means from deformation, which in turn prevents the spring forces from being lowered due to the leaf spring means taking a permanent set.

2. A receptacle terminal as recited in claim 1, wherein said auxiliary leaf spring means has a T-shaped configuration when stamped out of said bottom wall and is finally formed to have an arcuate contact section with an outer leg of the T being aligned substantially perpendicular to the bottom wall.

3. A receptacle terminal as recited in claim 1, wherein said main leaf spring means has two spring members positioned parallel to each other on the left and right sides of a longitudinal axis of said receptacle portion.

4. A receptacle terminal as recited in claim 3, wherein said free end means of said main leaf spring means are bent so that when the main leaf spring means are not engaged by the tab portion the free end means are substantially parallel to the bottom wall.

5. A receptacle terminal as recited in claim 1, wherein the end means of the main leaf spring means has embossments to allow for better electrical connection with said tab portion.

6. A receptacle terminal as recited in claim 1, wherein the upper wall has inwardly directed longitudinal projection means which make contact with the tab portion.

7. A receptacle terminal as recited in claim 1, wherein said receptacle terminal has wire terminating means.

8. A receptacle terminal for electrical engagement with a tab member of a male terminal, comprising:

receptacle means having a bottom section and an upper section;

main spring contact means at a forward end of said receptacle means extending inwardly along said receptacle means and inclined toward said upper section and terminating in free end means;

auxiliary spring contact means located within said receptacle means and spaced from said main spring contact means;

first stop means against which said free end means of said main spring contact means engages when the tab member is improperly inserted within said receptacle means thereby preventing overstressing of said main spring contact means; and second stop means provided by said auxiliary spring contact means for engagement with said bottom section during continued improper insertion of the tab member within the receptacle means thereby preventing overstressing of said auxiliary spring contact means.

9. A receptacle terminal as recited in claim 8, wherein said first stop means is said auxiliary spring contact means.

10. A receptacle terminal as recited in claim 8, wherein said second stop means is an arcuate shaped free end of said auxiliary spring contact means.

11. A receptacle terminal as recited in claim 8, wherein said main spring contact means has two spring members positioned parallel to each other on the left and right sides of a longitudinal axis of said receptacle means.

12. A receptacle terminal as recited in claim 8, wherein the upper section has inwardly directed longitudinal projections means which make contact with the tab member.

13. A receptacle terminal comprising:

a receptacle portion having a bottom wall and an upper wall;

main leaf spring means extending from a forward end of said bottom wall, the main leaf spring means being bent so as to extend backward into said receptacle portion along the bottom wall at an inclined angle relative thereto, free end means of said main leaf spring means spaced from said upper wall a distance less than the thickness of a tab portion of a male terminal;

auxiliary leaf spring means extending from said bottom wall and extending backward into said receptacle portion along the bottom wall at an inclined angle relative to the bottom wall, free end means of the auxiliary leaf spring means spaced from said upper wall at a distance less than the thickness of said tab portion;

the main leaf spring means having a first stop means and the auxiliary spring means having a second stop means, whereby upon the tab portion being inserted into the receptacle portion, the first stop means can engage the bottom wall, and upon further insertion of the tab portion, the auxiliary leaf spring means will move, such that the second stop means will engage the bottom wall when the tab portion is improperly inserted into the receptacle portion, thereby preventing the leaf spring means from deformation, which in turn prevents the spring forces from being lowered due to the leaf spring means taking a permanent set.

in view of the amendments, the application is respectfully submitted to be in condition for allowance.

14. A receptacle terminal as recited in claim 13, wherein said auxiliary leaf spring means has a T-shaped configuration when stamped out of said bottom wall and is finally formed to have an arcuate contact section with an outer leg of the T being aligned substantially perpendicular to the bottom wall.

15. A receptacle terminal as recited in claim 13, wherein said main leaf spring means has two spring members positioned parallel to each other on the left and right sides of a longitudinal axis of said receptacle portion.

16. A receptacle terminal as recited in claim 15, wherein said free end means of said main leaf spring means are bent so that when the main leaf spring means are not engaged the free end means are substantially parallel to the bottom wall.

17. A receptacle terminal as recited in claim 13, wherein the end means of the main leaf spring means has embossments to allow for better electrical connecting with said tab portion.

18. A receptacle terminal as recited in claim 13, wherein the upper wall has inwardly directed longitudinal projection means which make contact with the tab portion.

19. A receptacle terminal as recited in claim 13, wherein said receptacle terminal has wire terminating means.

* * * * *

UNITED STATES PATENT OFFICE

CERTIFICATE OF CORRECTION

Patent No. 4,699,444 Dated October 13, 1987

Inventor(s) Shigeru Isohata

It is certified that error appears in the above-identified patent and that said Letters Patent are hereby corrected as shown below:

Column 6, lines 4 and 5 (Claim 13)

delete "in view of the amendments, the application is respectfully submitted to be in condition for allowance." from the end of Claim 13.

Signed and Sealed this

Twenty-fifth Day of October, 1988

*Attest:*

DONALD J. QUIGG

*Attesting Officer*

*Commissioner of Patents and Trademarks*